US008878035B2

(12) United States Patent
Stenbroten

(10) Patent No.: US 8,878,035 B2
(45) Date of Patent: Nov. 4, 2014

(54) STRING DEPRESSING DEVICE FOR A STRINGED MUSICAL INSTRUMENT

(71) Applicant: Scott Stenbroten, New York, NY (US)

(72) Inventor: Scott Stenbroten, New York, NY (US)

( * ) Notice: Subject to any disclaimer, the term of this patent is extended or adjusted under 35 U.S.C. 154(b) by 45 days.

(21) Appl. No.: 13/664,128

(22) Filed: Oct. 30, 2012

(65) Prior Publication Data

US 2013/0118334 A1 May 16, 2013

Related U.S. Application Data

(60) Provisional application No. 61/552,840, filed on Oct. 28, 2011.

(51) Int. Cl.
*G10D 3/00* (2006.01)
*G10D 3/04* (2006.01)

(52) U.S. Cl.
CPC ..... *G10D 3/043* (2013.01)
USPC ..... 84/318; 84/317

(58) Field of Classification Search
USPC ..... 84/318
See application file for complete search history.

(56) References Cited

U.S. PATENT DOCUMENTS

| | | | | | |
|---|---|---|---|---|---|
| 3,568,560 | A | * | 3/1971 | Chang et al. | 84/317 |
| 3,776,088 | A | * | 12/1973 | Jones | 84/317 |
| 3,995,523 | A | * | 12/1976 | Clarke | 84/317 |
| 4,270,432 | A | * | 6/1981 | Wilkerson | 84/318 |
| 4,331,059 | A | * | 5/1982 | Marabotto | 84/317 |
| 4,566,365 | A | * | 1/1986 | Huston, Jr. | 84/317 |
| 4,796,506 | A | * | 1/1989 | Gray | 84/317 |
| 5,623,110 | A | * | 4/1997 | Hoglund et al. | 84/318 |
| 2013/0239772 | A1 | * | 9/2013 | Perry | 84/317 |

* cited by examiner

*Primary Examiner* — Christopher Uhlir

(57) ABSTRACT

A string depressing device is useable to fret at least one string of a stringed musical instrument. The string depressing device includes a frame that, when adjacent to a fingerboard of the stringed musical instrument, extends both along and across the fingerboard and above the strings. A plurality of protruding compressible resilient members extend from the frame toward the fingerboard. When the frame is pressed against the fingerboard, each protruding member sufficiently depresses an underlying string to fret that string. In an operative position, some of the protruding members are positioned over corresponding strings at desired positions along the fingerboard. A capo can be placed around the neck of the stringed instrument and over the frame to press the frame towards the fingerboard. This presses at least some protruding members against corresponding strings, and effectively frets those strings against the fingerboard at the desired positions to form a musical chord.

20 Claims, 7 Drawing Sheets

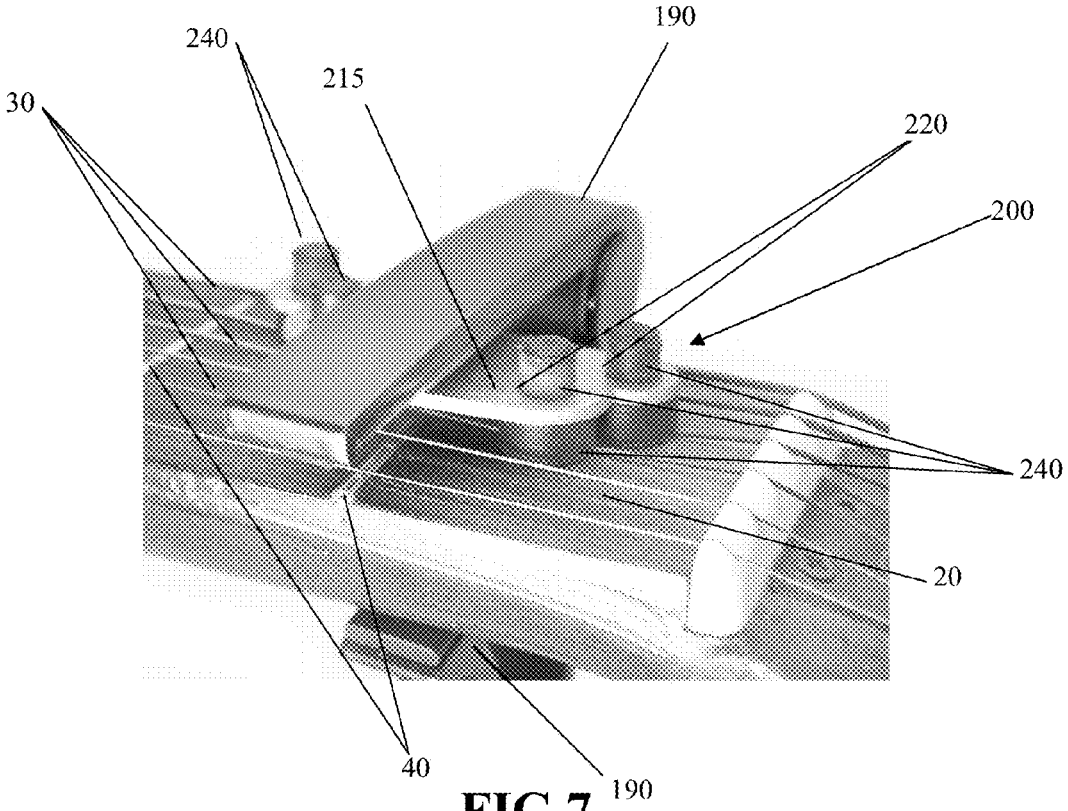
FIG.7
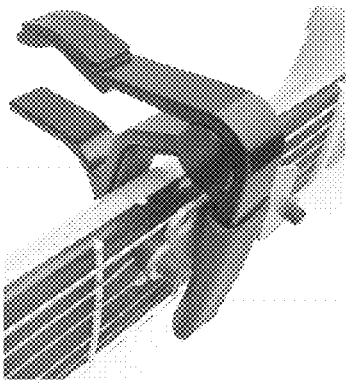
FIG. 8 (A)
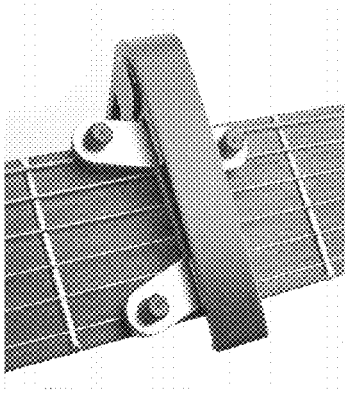
FIG. 8 (B)
FIG. 8

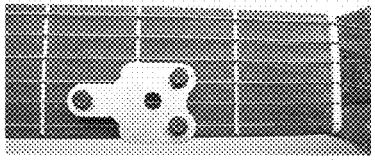
FIG. 9 (A)
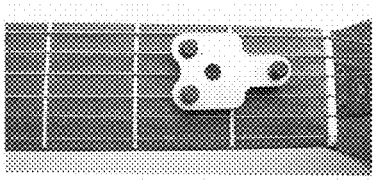
FIG. 9 (B)
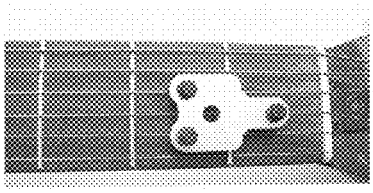
FIG. 9 (C)
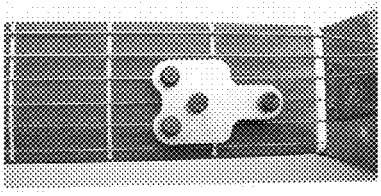
FIG.9 (D)
FIG. 9
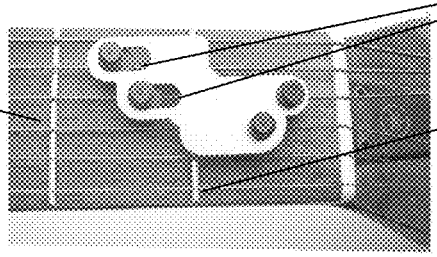
FIG. 10 (A)
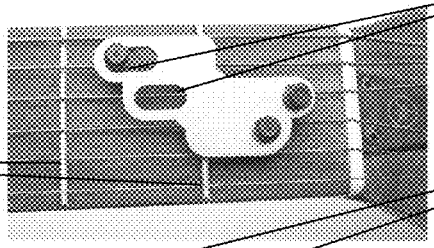
FIG. 10 (B)
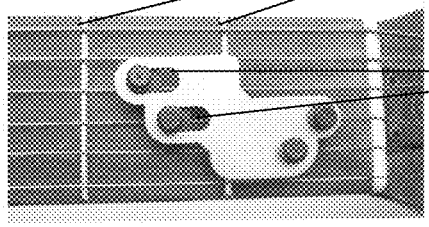
FIG. 10 (C)
FIG. 10

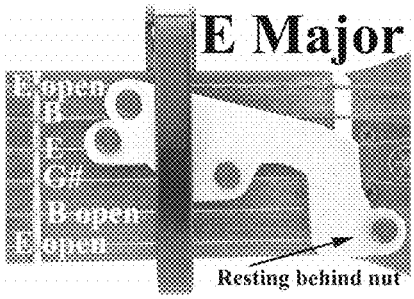
FIG. 11 (A)
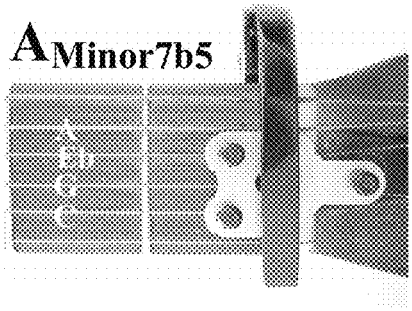
FIG. 11 (B)
FIG. 11
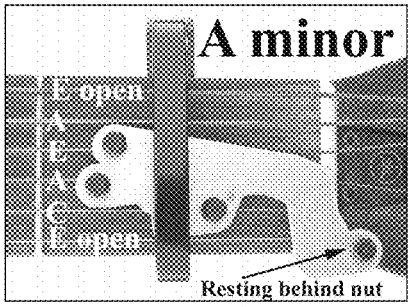
FIG. 12 (A)
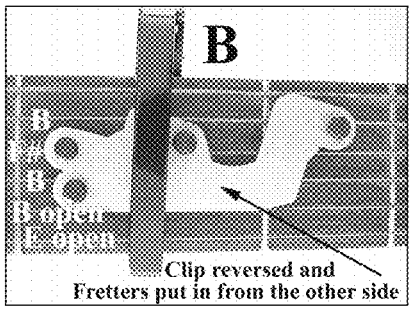
FIG. 12 (B)
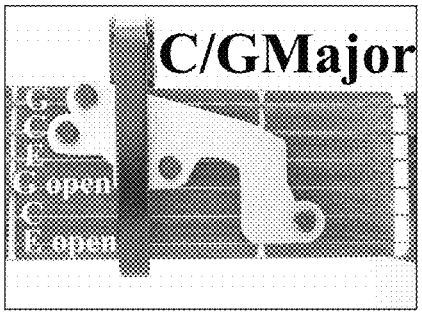
FIG. 12 (C)
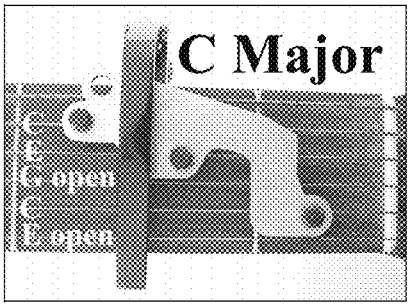
FIG. 12 (D)
FIG. 12

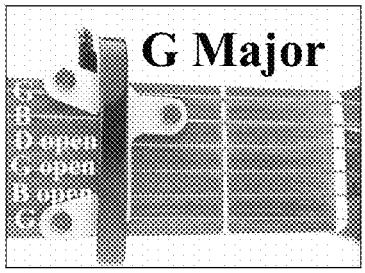
FIG. 13 (A)
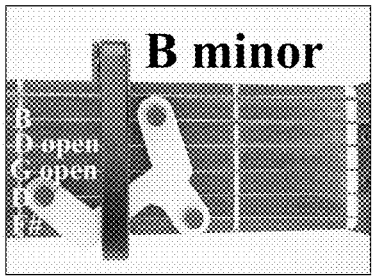
FIG. 13 (B)
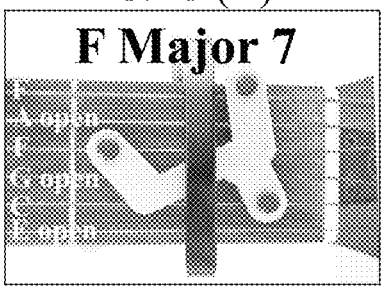
FIG. 13 (C)
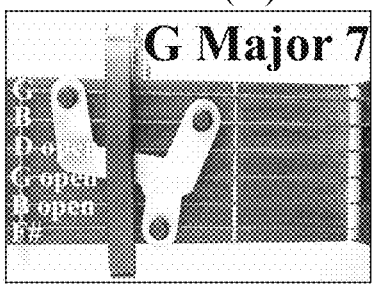
FIG. 13 (D)
FIG. 13
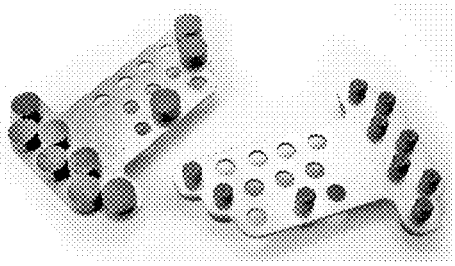
FIG. 14 (A)
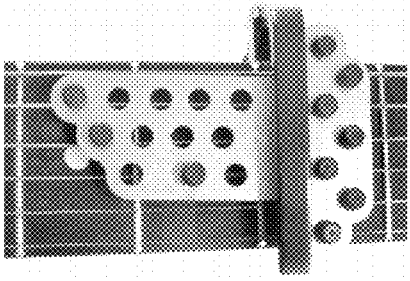
FIG. 14 (B)
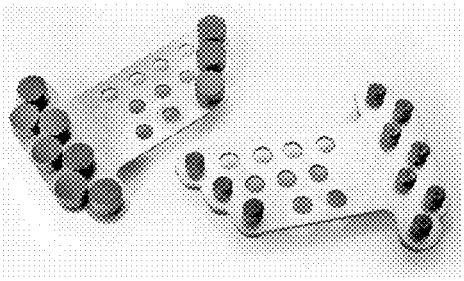
FIG. 14 (C)
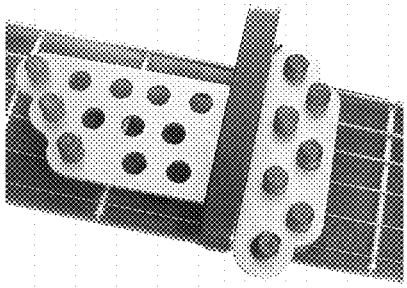
FIG. 14 (D)
FIG. 14

STRING DEPRESSING DEVICE FOR A STRINGED MUSICAL INSTRUMENT

CROSS REFERENCE TO RELATED APPLICATION

This application claims priority to U.S. Provisional Patent Application 61/552,840, filed Oct. 28, 2011, the entirety of which is hereby incorporated herein by reference.

BACKGROUND OF THE INVENTION

1. Field

The invention relates to chord playing attachments for stringed musical instruments.

This invention relates to chord playing attachments for stringed musical instruments such as guitars, basses, banjos, ukuleles, mandolins and the like, and more particularly to an improved chord playing attachment and the playing of intervallic note combinations with more variety of fingering combinations.

2. Description of Related Art

Conventional capos allow certain strings to be engaged when the capo is fitted to the neck of the instrument usually between two frets. However, it would be difficult or impossible to use a conventional capo to press down selected strings spanning more than that space between two frets and hold down the notes to form a chord much as the human hand does when playing a stringed musical instrument.

Currently available chord playing attachments are cumbersome bulky machines with complex buttons and levers that cover up large sections of the fingerboard making it difficult if not impossible for a players fingers to access notes and or strings in close proximity to that device, therefore inhibiting the user from playing and or fretting notes close to, inside of over the top of or behind that device, limiting the note combinations available, and limiting its musical/compositional usefulness. Because of all the various components they utilize the price of manufacturing is often high and therefore the cost of a consumer purchasing one is also high and this limits its appeal.

Often these devices need semi permanent mounting on a stringed instrument neck making them difficult to use in a performance setting where the musician has limited time between songs to make adjustments to the mechanics of their instrument.

The size and look of these devices can make the instrument appear strange and aesthetically non-pleasing to the human eye, and in the area of musical performance where the look is very important this can be a detriment.

SUMMARY

An innovative chord forming capo clip according to this invention is used to mechanically press down one or more of the strings of a stringed instrument corresponding to the notes of a given chord, relieving the stringed instrument's player from having to individually finger each of those strings in the correct chord fingering pattern. This frees the player's fingers, allowing the player to finger other strings, and/or one or more of those strings at higher frets. This translates into an endless variety creative new musical possibilities, enabling a player to have a broader pallet of sound and in many cases using very easy to play fingerings therefore giving a less advanced player access to richer chords and sounds only previously available to more advanced players if available at all. The new musical possibilities permitted when using a chord forming capo clip according to this invention include such things as open tuning sounds without having to retune one or more strings to a new note, moving inner chord voicings, chords easily layered on top of or against each other (or polytonality) and easy-to-play moving baselines, close voicings, two strings playing the same note, just to name a few. The chord forming capo clip according to this invention will make it easier for beginning players to play more complex and beautiful sounding music and can be a springboard of new songs and musical ideas for players ranging from the beginner to the advanced and or professional.

A compression device usable with the chord forming capo clip according to this invention is any kind of string musical instrument capo for example but not limited to a spring-clamp "trigger-style" capo. The chord forming capo clip can interact with the stringed musical instrument on any fret position from the lowest fret to the highest fret. The chord forming capo clip can be moved up and down the neck horizontally, vertically and at any angle allowing it to be used to create endless chord and note combinations and or musical variations. This makes it highly useful to a stringed instrument player and or composer. The chord forming capo clip can be in any shape, size, thickness, and can interact with a stringed instrument at any angle. The chord forming capo clip 200 can be integrated into a compression device, instead of these devices being two separate structures. The chord forming capo clip and compression device can be permanently attached to each other.

The present invention further relates to a method for mechanically depressing at least one string of a stringed instrument, the stringed instrument having a head, a body, a neck connecting the head and body, a plurality of strings extending along the neck at least between the head and the body and a plurality of tuning pegs, each string wound around a corresponding tuning peg, wherein rotating a tuning peg alters a tension on the corresponding string, and the tension on that string determines a pitch of that string, to form a desired pattern of string depression of the plurality of strings without having to change the pitches of the strings using the tuning pegs and independently of a player of the stringed instrument using the player's fingers to fret the strings, the desired pattern corresponding to a musical chord, the method comprising: locating an open compression device at a desired location along the neck, the open compression device extending at least partially around the neck of the stringed instrument; inserting a frame between the open compression device and at least one string of the stringed instrument and above the top surface of the neck, the frame having a plurality of protruding compressible resilient members located at defined relative positions of the frame based on the desired pattern of string depression of the plurality of strings; positioning the frame relative to the neck at the desired location such that at least one of the plurality of protruding compressible resilient members is located above a corresponding one of the plurality of strings at a position along the neck such that each such protruding compressible resilient member will fret its corresponding underlying string in the desired pattern of string depression; applying a force of the compression device to a top portion of the frame and to a bottom surface of the neck of the stringed instrument to bias the frame towards the neck, such that each such protruding compressible resilient member is pressed against the corresponding one of the plurality of strings to engage the plurality of strings in the desired pattern while the frame remains spaced from the plurality of strings such that each note of the musical chord rings clear and any open strings of the musical chord are not contacted by the frame or by any of the protruding compressible resilient members.

The present invention further relates to A string-depressing device usable to fret at least one string of a stringed musical instrument and a compression device, the stringed musical instrument having a neck and a plurality of strings extending along the neck, the string depressing device comprising: a frame member having a generally planar body, a first surface and an opposing second surface, wherein the first surface of the frame member includes an area useable to interact with the compression device; a plurality of apertures formed in the generally planar body; a plurality of protruding compressible resilient members, each protruding compressible resilient member located in one of the plurality of apertures, wherein the plurality of protruding compressible resilient members extend from the second surface and act as at least one of string depressors and support spacers when the frame is located between the compression device and the stringed musical instrument fingerboard.

These and other features and advantages of this invention are described in or are apparent from the following detailed description of the preferred embodiments.

BRIEF DESCRIPTION OF THE DRAWINGS

Various exemplary embodiments of this invention will be described in detail, with reference to the following figures, wherein:

FIG. 6(A) illustrates a first chord forming capo clip according to the first exemplary embodiment that provides a C chord fingering pattern;

FIG. 6(B) illustrates a first chord forming capo clip according to a third exemplary embodiment, where this chord forming capo clip is arranged in a G chord fingering pattern;

FIG. 6(C) illustrates a second chord forming capo clip according to the first exemplary embodiment, where this chord forming capo clip is arranged in a D chord fingering pattern;

FIG. 6(D) illustrates a first chord forming capo clip according to the second exemplary embodiment, where this chord forming capo clip is arranged in a E chord fingering pattern;

FIG. 7 shows is a lower rear view of the chord forming capo clip of FIGS. 4 and 6(D) forming the second fingering pattern, the string instrument fingerboard, the plurality of strings and the compression device;

FIG. 8 shows the first chord forming capo clip according to the third exemplary embodiment of the chord forming capo clip according to this invention shown in FIG. 6(B), the string instrument fingerboard, the plurality of strings and the compression device, where the single hole pattern provided in this first chord forming capo clip can be used to implement two different chord fingering patterns;

FIG. 8(A) shows the first chord forming capo clip according to the third exemplary embodiment arranged and relatively positioned to form a chord fingering pattern corresponding to a C chord;

FIG. 8(B) shows the first chord forming capo clip according to the third exemplary embodiment arranged and relatively positioned to form a chord fingering pattern corresponding to a G chord;

FIG. 9 shows the first chord forming capo clip of FIG. 1 according to the first exemplary embodiment of this invention and the string instrument fingerboard and the plurality of strings used to implement a plurality of different chord fingering patterns;

FIG. 9(A) illustrates the first chord forming capo clip=configured and relatively positioned to form a chord fingering pattern corresponding to a D chord;

FIG. 9(B) illustrates the first chord forming capo clip configured and relatively positioned to form a chord fingering pattern corresponding to a B 7 or Emaj 7 sus 4 chord;

FIG. 9(C) illustrates the first chord forming capo clip configured and relatively positioned to form a chord fingering pattern corresponding to an A major 7 chord;

FIG. 9(D) illustrates the first chord forming capo clip configured and relatively positioned to form a chord fingering pattern corresponding to an A chord;

FIG. 10 shows the first chord forming capo clip of FIG. 4 according to the second exemplary embodiment of this invention and a string instrument fingerboard and a plurality of strings;

FIG. 10(A) illustrates the first chord forming capo clip configured and relatively positioned to form a chord fingering pattern corresponding to an E chord;

FIG. 10(B) illustrates the first chord forming capo clip configured and relatively positioned to form a chord fingering pattern corresponding to an E major 7 chord;

FIG. 10(C) illustrates the first chord forming capo clip configured and relatively positioned to form a chord fingering pattern corresponding to an A Minor chord;

FIG. 11(A) illustrates a second chord forming capo clip according to the third exemplary embodiment configured and relatively positioned to form a chord fingering pattern corresponding to an E chord;

FIG. 11(B) illustrates the first chord forming capo clip of FIG. 1 configured and relatively positioned to form a chord fingering pattern corresponding to an A minor 7 b5 chord;

FIG. 12 shows the second chord forming capo clip of FIG. 11(B), the string instrument fingerboard, the plurality of strings and the compression device;

FIG. 12(A) illustrates the second chord forming capo clip configured and relatively positioned to form a chord fingering pattern corresponding to an A minor chord;

FIG. 12(B)) illustrates the second chord forming capo clip configured and relatively positioned to form a chord fingering pattern corresponding to a B chord;

FIG. 12(C)) illustrates the second chord forming capo clip configured and relatively positioned to form a chord fingering pattern corresponding to a C/G chord;

FIG. 12(D)) illustrates the second chord forming capo clip configured and relatively positioned to form a chord fingering pattern corresponding to a C chord;

FIG. 13 shows a first exemplary embodiment of a chord forming capo clip according to this invention, a string instrument fingerboard, a plurality of strings and a compression device;

FIG. 13(A) illustrates the first chord forming capo clip according to the first exemplary embodiment configured and relatively positioned to form a chord fingering pattern corresponding to a G chord;

FIG. 13(B) illustrates the first chord forming capo clip according to the first exemplary embodiment configured and relatively positioned to form a chord fingering pattern corresponding to a B minor chord;

FIG. 13(C) illustrates the first chord forming capo clip according to the first exemplary embodiment configured and relatively positioned to form a chord fingering pattern corresponding to a F maj7 chord; and FIG. 13(D) illustrates the first chord forming capo clip according to the first exemplary embodiment configured and relatively positioned to form a chord fingering pattern corresponding to a G maj7 chord;

FIG. 14 shows a fourth exemplary embodiment of a chord forming capo clip according to this invention, as well as a string instrument fingerboard, a plurality of strings and a compression device that provides a bar chord;

FIG. 14(A) illustrates a first arrangement of the fourth exemplary chord forming capo clip arranged in a fingering pattern corresponding to a G bar chord;

FIG. 14(B) illustrates the chord forming capo clip of FIG. 14(A) relatively positioned to form a chord fingering pattern corresponding to a G bar chord;

FIG. 14(C) illustrates a second arrangement of the fourth exemplary chord forming capo clip arranged in a fingering pattern corresponding to a D bar chord; and FIG. 14(D) illustrates the chord forming capo clip of FIG. 14(A) relatively positioned to form a chord fingering pattern corresponding to a D bar chord fingering pattern.

Figure 1:
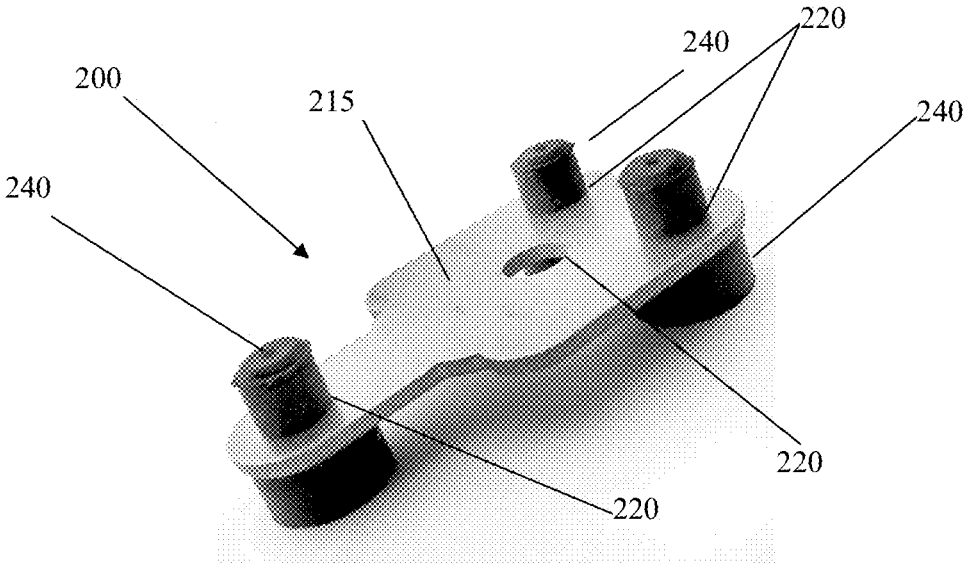
FIG. 1 shows a first exemplary embodiment of a chord forming capo clip according to this invention.

While the disclosure is susceptible to various modifications and alternative forms, specific embodiments thereof have been shown by way of example in the drawings and are herein described below in detail. For example, any numbers, measurements, and/or dimensions illustrated in the Figures are for purposes of example only. Any number, measurement or dimension suitable for the purposes provided herein may be acceptable. It should be understood that the description of specific embodiments is not intended to limit the disclosure from covering all modifications, equivalents and alternatives falling within the spirit and scope of the disclosure.

DETAILED DESCRIPTION OF EXEMPLARY EMBODIMENTS

It should be appreciated that, in the following detailed description and corresponding figures, the chords and chord shapes named in the following detailed description and shown in the corresponding figures are based on a guitar tuned in standard guitar tuning E, A, D, G, B, E. It should also be appreciated that a guitar capo is one of the most common device used by a guitar player besides a guitar pick and a guitar strap. The chord forming capo clip according to this invention offers an inventive and economical way to make the common capo a more useful tool.

Figure 2:
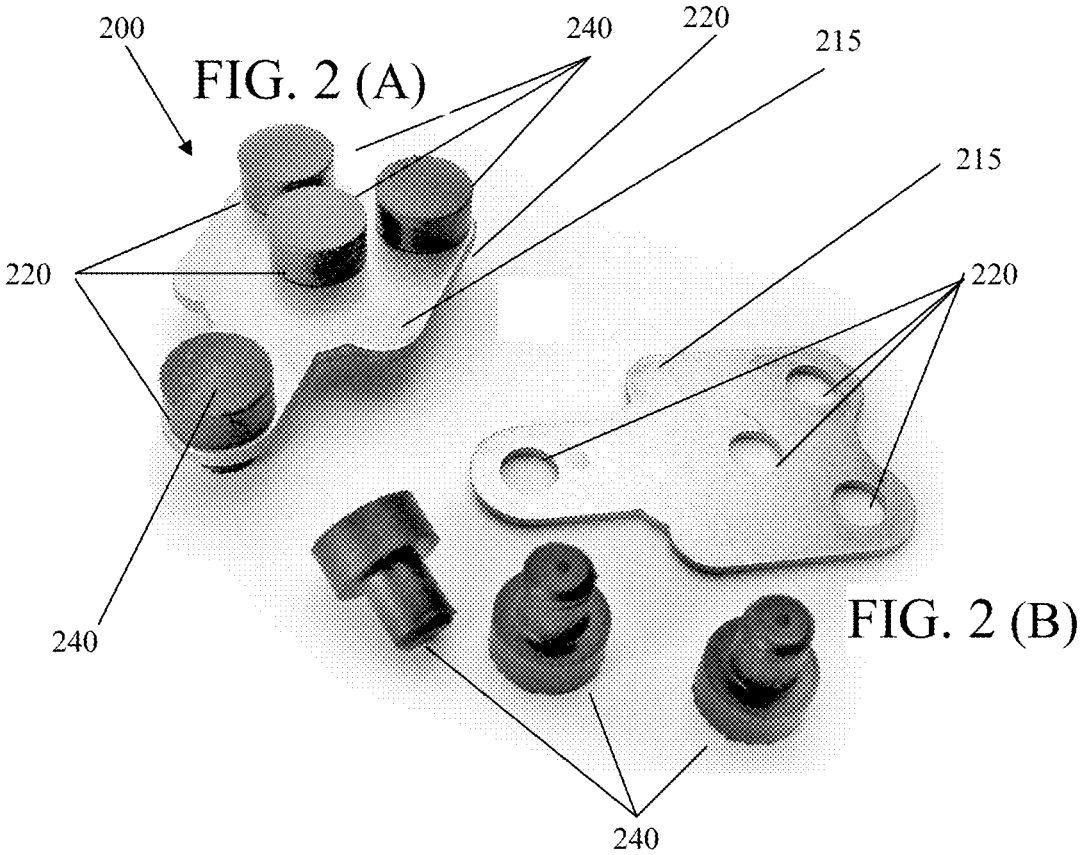
FIG. 2(A) shows in greater detail the first exemplary embodiment of a chord forming capo clip according to this invention.
FIG. 2(B) shows a first exemplary embodiment of a rigid platform and a plurality of inserts of the first exemplary embodiment of the chord forming capo clip shown in FIG. 2(A)

FIG. 1 is a chord forming capo clip 200 in a shape that would create a basic D chord pattern on a guitar. In particular, FIG. 1 is a upper ¾ view of a chord forming capo clip 200 with three inserts 240 in holes 220 on a rigid platform 215 with an empty hole 220 in the center. Inserts 240 are in a pattern that would fret the notes of several chords most obviously a D chord when compressed to the neck of a guitar. FIG. 2(A) shows the same chord forming capo clip 200 as FIG. 1 but flipped upside down showing the underside and showing four inserts 240 that fret strings 30 inserted into the ridged platform 215 with the holes 220 being obstructed from view. FIG. 2(B) is the same chord forming capo clip as seen in FIG. 1 with the inserts 240 removed from the ridged platform 215 and three inserts 240 in the foreground.

Figure 3:
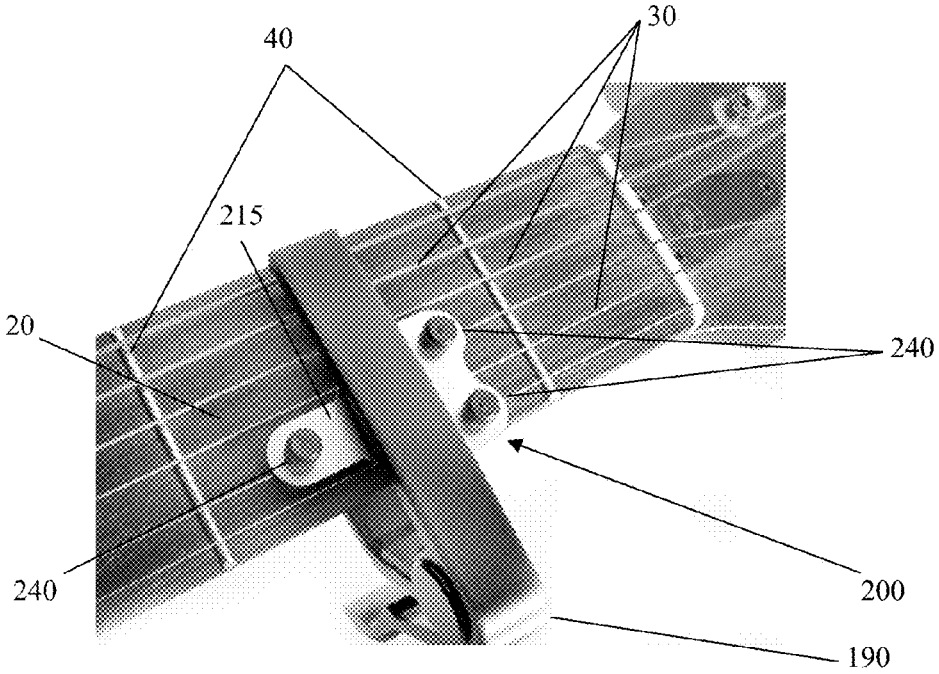
FIG. 3 shows the first exemplary embodiment of the chord forming capo clip forming a first finger pattern, a string instrument fingerboard, a plurality of strings and a compression device.
Figure 4:
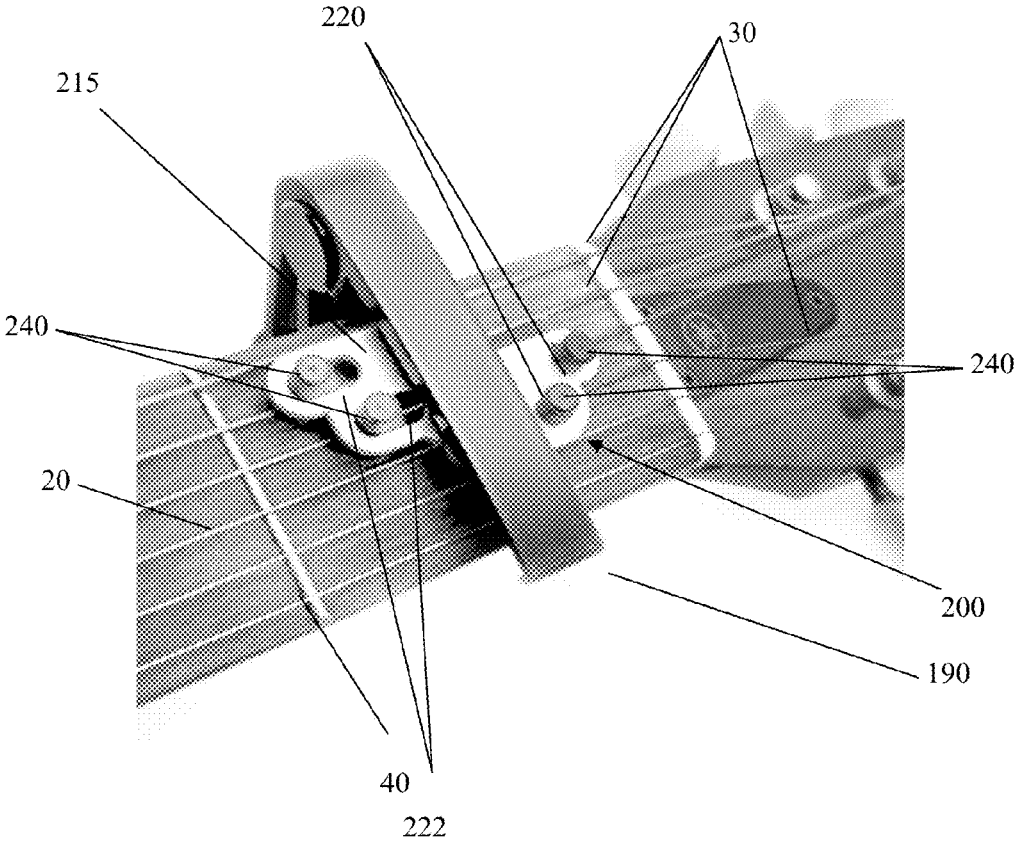
FIG. 4 shows a second exemplary embodiment of a chord forming capo clip forming a second fingering pattern; the string instrument fingerboard, the plurality of strings and the compression device.

FIG. 3 shows a frontal view of the same chord forming capo clip 200 as FIG. 1 compressed to the neck of a guitar with a spring clamp trigger capo 190 relatively positioned to form a chord fingering pattern corresponding to a D chord, this being one of many potential chord patterns that can be implemented using this rigid platforms hole 220 configuration. Note the second fret 40 and the middle hole 220 is empty and obstructed from view as the spring clamp trigger capo 190 is resting over it. FIG. 4 shows a chord forming capo clip 200 pressed to the neck of a guitar with a spring clamp trigger capo 190 and pressing down the strings 30 in a E chord pattern, which is one of many potential chord patterns available with this rigid platform's hole 220 and slot 222 configuration. The first fret 40 is obstructed from view as the spring clamp trigger capo 190 is resting over it, this allowing for greater access for a players fingers to play strings in front of and behind that first fret, the two inserts to the left are inserted into slots 222 that allow adjustment of the inserts 240. For example if the chord forming capo clip 200 were moved to a position on the neck where the frets 40 were closer together, an adjustment of the inserts 240 closer to the center along these slots 222 would allow a chord pattern to be formed in a smaller space, for example higher up the neck of the guitar where the frets 40 are closer together.

Figure 5:
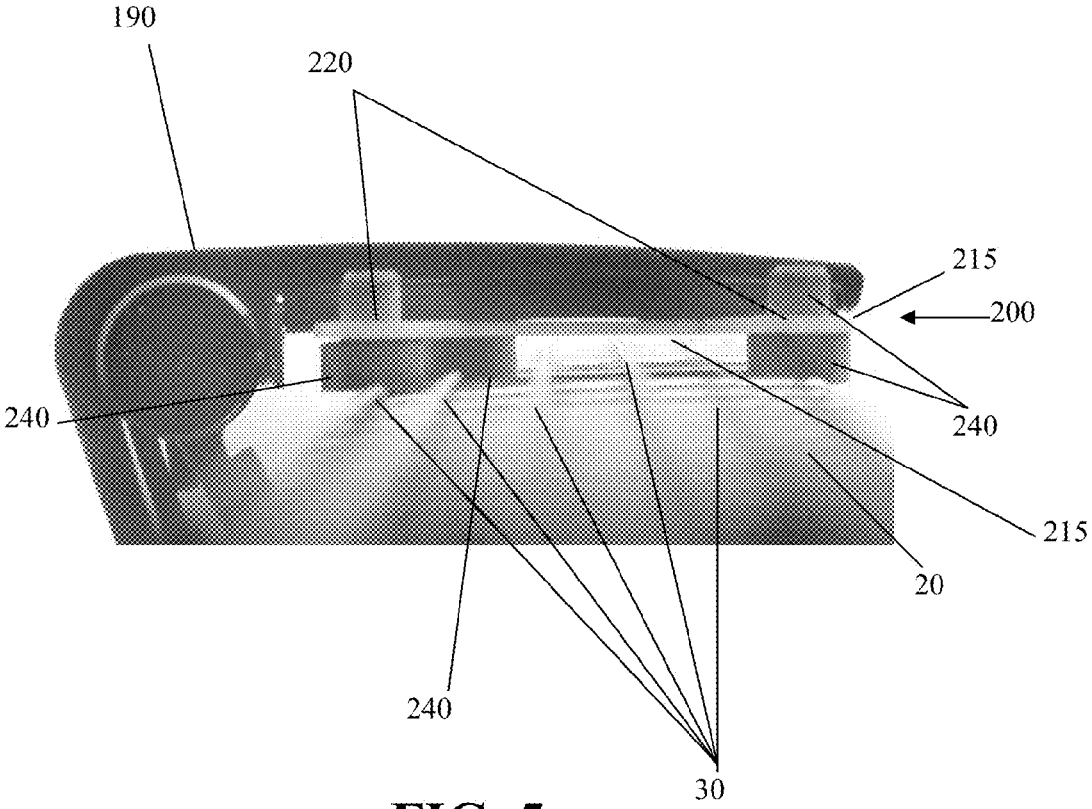
FIG. 5 shows a low angle view of the first exemplary embodiment of the chord forming capo clip of FIG. 1 forming a third fingering pattern, the string instrument fingerboard, the plurality of strings and the compression device.

FIG. 5 is a low angle profile view showing a chord forming capo clip 200 pressed to the neck of a guitar with a spring clamp trigger capo 190, pressing down the strings 30 in a G chord pattern this being one of many potential chord patterns available with this rigid platforms hole 220 configuration. The farthest left two strings are pressed to the fingerboard while the next three strings pass un-touched beneath the rigid platform 215 and the spring clamp trigger capo 190 while the string 30 farthest to the right is pressed to the fingerboard. In this exemplary embodiment, the thickness of the inserts 240 from the rigid platform 215 to the strings 20 is at a desired height that allows three strings 30 to pass beneath untouched while not being too tall as to make the compression device difficult to enclose around the neck and chord forming capo clip 200.

Figure 6:
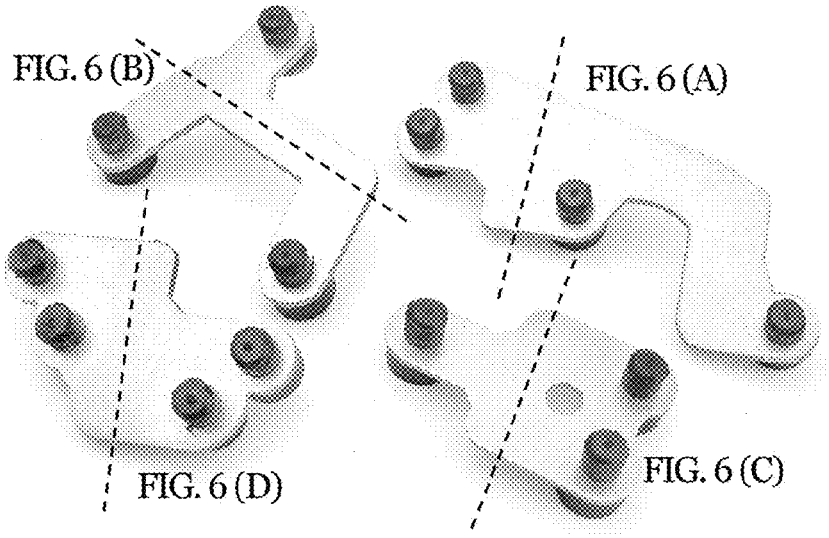
FIG. 6 illustrates 4 different chord forming capo clips according to this invention.

FIG. 6 shows four chord forming capo clips 200. Each is arranged in a pattern corresponding to a different guitar chord. The dotted lines represent a preferred surface area where a compression device could engage and press down onto the chord forming capo clip. Although that is not the only area available for the compression device to have contact that area has a greater amount of the rigid platform's 215 mass making and is usually located above a fret this allowing the areas of the string instrument fingerboard 20 between the frets to have less rigid platform 215 covering them and be more open and accessible to the fingers of a player for accessing and pressing down strings. Because a certain amount of force is needed to hold a string 30 to a fingerboard 20 in order for it to sound a note when played, the concentration of the rigid platforms mass in this area allows for maximum distribution of the force from the compression device that travels over the rigid platform, through the inserts 240 and onto the strings 30 and string instrument fingerboard 20.

FIGS. 6(C) and 6(D) illustrate first and second exemplary embodiments of chord forming capo clips according to this invention, while FIG. 6(B) illustrates a third exemplary embodiment of chord forming capo clips according to this invention, as well, along with FIG. 6(D), illustrating different chord classes of chord forming capo clips according to this invention. In particular, FIG. 6(C) shows the first exemplary embodiment, where the platform 215 includes more holes 220 than inserts 240 and where the inserts 240 can be removed from the holes 220. In contrast, FIGS. 4 and 6(C) show the second exemplary embodiment, where the one or more of the holes 220 are oblong instead of round and where the inserts 240 can be moved within those oblong holes 220. Finally, FIG. 6(C) shows a third exemplary embodiment, where the platform 215, rather than having a generally simple peripheral edge, instead has a number of legs and/or a number of recesses or cutouts along its periphery, with the holes 220 provided in those legs and/or on various sides of the recesses or cutouts. This more complicated peripheral edge allows the player to access regions along various ones of the strings 30 that would otherwise be covered by and inaccessible beneath the platform 215.

Additionally, FIG. 6(A) shows a C class chord forming capo clip 200. FIG. 6(B) shows a G class chord forming capo clip 200. FIG. 6(C) shows a D class chord forming capo clip 200. FIG. 6(D) shows an E class chord forming capo clip 200.

FIG. 7 is a lower rear view of a chord forming capo clip 200 configured and relatively positioned to form an E chord chord-fingering pattern and pressed to the neck of a guitar with a spring clamp trigger capo 190 seen applying compression above and below the neck. This angle also shows the two highest strings passing untouched under the spring clamp capo 190 as it lays above the first fret 40, leaving space for the two highest strings to be accessible to playing fingers.

FIG. 8(A) is a upper view looking down of a C class chord forming capo clip 200 pressed to the neck of a guitar with a spring clamp capo 190 and configured and relatively positioned to form a C chord chord-fingering pattern, partially showing the highest and lowest strings 30 passing untouched, also showing a very clear view of a spring clamp trigger capo 190 compressing the chord forming capo clip to the string instrument fingerboard. FIG. 8(B) is a frontal view of a G class chord forming capo clip forming a G chord pattern, and clearly showing a area of fingerboard open and accessible for fingers to interact and fret strings between the two left inserts 240 on the A, D, G, B strings 30 and to the right of the spring clamp 190 capo on the D, G and B strings.

FIG. 9 is a frontal view of the D class capo clip, which is the same chord forming capo clip 200 as seen in FIG. 1, laying on the strings 30 of a guitar without a compression device. In particular, FIG. 9 shows how the mass of the ridged platform 215 is concentrated directly over the fret 40 where the spring clamp trigger capo 190 would be placed to press it to the neck of the instrument. This group of 4 images also shows how one chord forming capo clip 200 can be used to form 4 different chords.

The chord forming capo clip 200 shown in FIG. 9(A) is configured and relatively positioned on the fingerboard to form a D chord chord-fingering pattern, the center hole 220 left empty. The chord forming capo clip 200 shown in FIG. 9(B) is configured and relatively positioned on the fingerboard to form a B 7 chord chord-fingering pattern. The B 7 chord is also known as a Emaj 7 sus 4 chord. The chord forming capo clip 200 shown in FIG. 9(C) is configured and relatively positioned on the fingerboard to form an A major 7 chord chord-fingering pattern. The chord forming capo clip 200 shown in FIG. 9(D) is configured and relatively positioned on the fingerboard to form an A chord chord-fingering pattern, with an additional insert 240 inserted in the middle hole 220 to press down the B string at a location for sounding a C# note.

FIG. 10 is a E class chord forming capo clip 200, and is the same as that shown in FIG. 4, FIG. 6(D) and FIG. 7, here lying on the strings 30 of a guitar without a compression device and showing how the mass of the ridged platform 215 is concentrated directly over the first fret 40 where the spring clamp trigger capo 190 would press it to the neck of the guitar. Also visible are the slots 222 that allow horizontal adjustment of the inserts 240 on the left side of the chord forming capo clip 200. The chord forming capo clip 200 shown in FIG. 10(A) is configured and relatively positioned on the fingerboard to form an E chord chord-fingering pattern. The chord forming capo clip 200 shown in FIG. 10(B) is configured and relatively positioned on the fingerboard to form an E Major 7 chord chord-fingering pattern. Notice also that the insert 240 on the D string at the 2nd fret is removed, allowing the insert on the D string at the first fret to fret the D string at a location for sounding a D# note. The chord forming capo clip 200 shown in FIG. 10(C) is configured and relatively positioned on the fingerboard to form an A minor chord chord-fingering pattern.

FIG. 11, shows two different chord forming capo clips that are positioned along the fingerboard such that a portion of the platform and insert 240 extend beyond the nut and or playable area. FIG. 11(A) shows a C class chord forming capo clip configured and relatively positioned on the fingerboard to form an E chord chord-fingering pattern, FIG. 11(B) shows a D class chord forming capo clip configured and relatively positioned on the fingerboard to form an A minor7b5 chord chord-fingering pattern.

FIG. 12 shows a top view of a C class chord forming capo clip 200 shown pressed to the neck of the guitar with a spring clamp trigger capo, shown here configured and relatively positioned on the fingerboard to form four different chord fingering patterns. In particular, the chord forming capo clip 200 shown in FIG. 12(A) is configured and relatively positioned on the fingerboard to form an A minor chord chord-fingering pattern with a portion of the rigid platform 215 behind the nut and outside the playable are of the guitar neck. FIG. 12(B) shows, relative to the chord forming capo clip 200 shown in FIG. 12(A), the rigid platform 215 reversed and the inserts 240 inserted from the opposite side and relatively positioned on the fingerboard to form a B chord chord-fingering pattern. FIG. 12(C) is configured and relatively positioned on the fingerboard to form a C/G chord chord-fingering pattern with the upper left insert 240 forming the note G on the E string. FIG. 12(D) is configured and relatively positioned on the fingerboard to form a C chord chord-fingering pattern that is the exact same C chord pattern as shown in FIG. 8(A).

FIG. 13 is a top view of a G class chord forming capo clip 200 shown pressed to the neck of the guitar with a spring clamp trigger capo. In particular, as illustrated in FIG. 13, this G class chord forming capo clip 200 can be used to form 4 different chords patterns, by turning and or moving it, to fit the appropriate strings;

For example, the G class chord forming capo clip 200 shown in FIG. 13(A) is configured and relatively positioned on the fingerboard to form a G chord chord-fingering pattern, which is the same chord fingering pattern shown in FIG. 8(B). In contrast, the G class chord forming capo clip 200 shown in FIG. 13(B) is configured and relatively positioned on the fingerboard to form a B minor chord chord-fingering pattern. The G class chord forming capo clip 200 shown in FIG. 13(C) is configured and relatively positioned on the fingerboard to form a F maj7 chord chord-fingering pattern. Finally, the G class chord forming capo clip 200 shown in FIG. 13(D) is configured and relatively positioned on the fingerboard to form a G maj7 chord chord-fingering pattern.

FIG. 14 shows a fifth exemplary embodiment of a chord forming capo clip according to this invention, as well as a string instrument fingerboard, a plurality of strings and a compression device that provides a bar chord. In particular, FIG. 14 shows various views of a bar chord class of chord forming capo clip 200 with nineteen holes 220 in the rigid platform 215, the inserts 240 can be moved into any combination of holes 220 to form many different chord patterns, inserts 240 can also be removed allowing strings not to be touched by any part of this chord forming capo clip 200.

FIG. 14(A) shows top and bottom views of the fifth exemplary chord forming capo clip 200. As shown in FIG. 14(A), the inserts 240 are arranged into a fingering pattern that corresponds to a G bar chord. FIG. 14(B) shows the chord forming capo clip of FIG. 14(A) pressed to the neck of a guitar with a spring clamp trigger capo 190, pressing down the strings 30 in a chord fingering pattern that corresponds to the G bar chord. In contrast, FIG. 14(C) shows top and bottom views of the fifth exemplary chord forming capo clip 200 with the inserts 240 arranged into a fingering pattern that corresponds to a D bar chord. FIG. 14(D) shows the chord forming capo clip of FIG. 14(C) pressed to the neck of a guitar with a spring clamp trigger capo 190, pressing down the strings 30 in a chord fingering pattern that corresponds to the D bar chord.

It should be understood that every chord forming capo clip 200 shown in FIGS. 1-14 can form many different chord patterns and not all chord patterns have been presented in these figures or this application.

In some exemplary embodiments the innovative chord forming capo clip 200 described in this application is used to mechanically press down the notes of a chord on a stringed instrument. This translates into an endless variety creative new musical possibilities, enabling a player to have a broader pallet of sound and in many cases using very easy to play fingerings therefore giving a less advanced player access to richer chords and sounds only previously available to more advanced players if available at all. Including such things as open tuning sounds without having to retune one or more strings to a new note. moving inner chord voicings, chords easily layered on top of or against each other (or polytonality) and easy-to-play moving baselines, close voicings, two strings playing the same note, just to name a few. This device will make it easier for beginning players to play more complex and beautiful sounding music and be a spring board of new songs and musical ideas for players ranging from the beginner to the advanced and or professional.

In some exemplary embodiments a chord shaped capo clip is a ridged platform 215 with holes 220 that accept inserts 240 similar but not limited to rubber bumpers that can be precisely positioned to sandwich a string of a stringed instrument to its fretboard therefore fretting and creating the sound of a note and when a plurality of inserts 240 are patterned in the shape of a particular chord they can create the sound of that chord mechanically. Any insert 240 can be inserted or removed independently of each other and can be at a thickness that allows strings 30 not touched by them to pass below the rigid platform 215 without making contact therefore allowing them to ring out untouched when played or strummed.

In some exemplary embodiments, a subtle tuning peg adjustment may be required to fine tune the chord to its precise sonority. That adjustment is usually a pitch less than half a step, a half a step on a piano is for example C to C#.

In some exemplary embodiments a protruding compressible resilient member or a plurality of protruding compressible resilient members are inserts as listed as number 240 in this applications figures. In some exemplary embodiments the inserts 240 can be in any shape, configuration and or pattern and can interact with a stringed instrument at any angle, In some exemplary embodiments a frame as described in this applications claims is a rigid platform as shown as number 215 in this applications figures.

In some exemplary embodiments, a compression device is any kind of string musical instrument capo for example but not limited to a spring-clamp "trigger-style" capo. In some exemplary embodiments, the chord forming capo clips 200 can interact with the stringed musical instrument on any fret position from the lowest fret to the highest fret. In some exemplary embodiments, the chord forming capo clip 200 can be moved up and down the neck horizontally, vertically and at any angle allowing it to be used to create endless chord and note combinations and or musical variations. This makes it highly useful to a stringed instrument player and or composer. In some exemplary embodiments, the chord forming capo clips 200 can be in any shape, size, thickness, and interact with a stringed instrument at any angle. In some exemplary embodiments, the chord forming capo clip 200 is a compression device, instead of being two separate devices they are one device. In some exemplary embodiments, the chord forming capo clip 200 and compression device are permanently attached to each other.

In some exemplary embodiments the ridged platform 215 is in a shape made to maximize the force exerted from the capo while taking up minimal finger-able fretboard space allowing a player to have more space to fret strings in close proximity to the chord forming capo clip. For example, by positioning the compression device over the fret instead of in between the frets as most capos are used, and designing the rigid frame to have mass in that area over the fret while taking up as little space in between the frets as possible you allow for more space for the fingers to play and more musical/compositional possibilities. Examples of this can be seen on many of the figures but note FIGS. 9 and 10 as they show the chord forming capo clips in position without a capo obstructing the actual fret.

In some exemplary embodiments, the inserts 240 act as a support to balance the chord forming capo clip 200. The correct depth of the insert from the rigid platform 215 is crucial to allow the proper space for open strings to pass un touched and able to ring free if so desired, while not being so deep or tall that a spring clamp trigger capo will not fit comfortably around this configuration. FIG. 5 shows one example of this embodiment. In some exemplary embodiments, the height of the insert is altered by inserting a spacer in between the insert 240 and the rigid platform 215 for example but not limited to a washer or a o-ring. This might help to compensate for the different thickness of various strings.

In some exemplary embodiments the chord forming capo clip as seen in FIG. 3 has a slightly longer upper right insert 240 holding down the G string on the second fret. The distance of the insert 240 between the rigid platform and the string can be made longer in any number of ways including a simple O-ring between the insert 240 and rigid platform 215 this might be necessary to tip the end of the spring clamp trigger capo 190 away from the low E string providing enough clearance and space between that string to vibrate freely untouched by the tip of the capo.

In some exemplary embodiments the rigid platform 215 has one or more areas in the rigid platform open to allow a finger access to contact a string, For example but not limited to FIG. 11(A) referring to the cut away area in the rigid platform 215 between the two right side inserts 240.

In some exemplary embodiments the capo clip is referred to as a class of capo in order to help better explain it as a multifunctional device that can form many different fingering patterns to form many different chords. For example but not limited to the term E class chord forming capo clip 200 seen in FIG. 4 can be positioned to shape many different chords by applying variations to its position on the fretboard, angle it is positioned on the fretboard, number of inserts in use, etc. The class can be applied to any chord forming capo clip 200 disclosed in this application as seen in FIG. 6 for example C Class, D Class, G Class, and also any other variation of chord forming capo clip 200 or rigid platform 215 hole 220 or slot 222 pattern, including those based on other chords for example but not limited to F, B, Bar chord class, or universal shape class.

In some exemplary embodiments the chord forming capo clips presented in this application including the different class of chord forming capo clip is not limited in any way including the shape, size, or hole pattern of the rigid platform. For example but not limited to, the C class capo clip may be designed without the top upper left hole 220 or the G class chord forming capo clip may be designed with additional rigid platform 215 and hole 220 to allow a D note on the B string to be part of the chord pattern. All variation and redesign of these clips can be executed and is part of it's continued development within the scope of this application.

In some exemplary embodiments a chord forming capo clip 200 is made in a shape that would allow it to form any variation of a bar chord. A bar chord is a common chord where normally the index finger bars all 6 strings and the other fingers form the rest of the chord.

In some exemplary embodiments, the inserts 240 are removable allowing a user to create any combination of notes, chords, effects and or sounds. This includes but is not limited to the example seen in FIG. 10 of a chord forming capo clip 200 forming a E chord chord-fingering pattern. By removing one insert 240, the chord fingering pattern implemented by this chord forming capo clip 200 becomes a E major 7 chord chord-fingering pattern. In contrast, by moving this chord forming capo clip 200 down one string, the chord fingering pattern implemented by this chord forming capo clip 200 becomes an A minor chord chord-fingering pattern. This concept when utilized on different chord shaped capo clips 200 leads to endless variety and possible chord combinations.

In some exemplary embodiments the platform 215 inserts 240 and any part of the chord forming capo clip 200 are made of any appropriate material and may be in any appropriate shape, size, thickness, dimension and not limited to what is revealed in this document.

In some exemplary embodiments a compression device such as a spring clamp trigger capo 190 lays across the top side of a chord forming capo clip 200 above a fret 40 of a stringed musical instrument as seen in FIGS. 3, 4, 7, 8, 11 and 12. Traditional capo placement is usually between two frets. The placement of a capo above the fret is unique to this invention and allows a player to have access to more of the playable fingerboard. by leaving as much space between the frets 40 open and accessible allowing a players fingers to have room to access and play strings 30. This placement also distributes the force of the compression device evenly over the chord forming capo clip 200 this is a important feature as the chord forming capo clip may span over 2 or more frets.

In some exemplary embodiments the chord forming capo clip 200 can be pressed against the neck of a stringed instrument by being sandwiched between a traditional spring clamp trigger capo 190 (sometimes referred to as "quick release") and the neck of the stringed instrument and therefore holding down or fretting the desired strings 30 and leaving the other strings 30 untouched.

In some exemplary embodiments the compression device can interact or press against the ridged platform 215 and back of string instrument neck at any angle or position and in some cases come in contact with only a portion of the back of the neck.

In some exemplary embodiments the chord forming capo clip 200 and the spring clamp trigger capo 190 connect together and are attached and detached to each other by any method of attachment including but not limited to magnets, hook and loop, snaps and tongue and groove attachment.

In some exemplary embodiments a compression device is made to enclose a stringed instrument fingerboard 20 and a chord forming capo clip 200 and compensates for the extra distance needed to open, and other aspects of its purpose is designed and manufactured towards enclosing a stringed instrument fingerboard 20 and a chord forming capo clip 200 including the tension, span of opening space and shape of all components. As most currently available capos are not specifically made to enclose a stringed instrument fingerboard 20 and a chord forming capo clip 200 this embodiment is specifically made for that purpose.

In some exemplary embodiments the spring clamp trigger capo 190 and the chord forming capo clip 200 connect to each other with a magnetic force. For example the spring clamp trigger capo 190 has a magnetic component and the chord forming capo clip 200 is entirely or partially made out of a type of steel that is attracted to a magnet for example 400 series alloy stainless steel allowing both components to be attached and detached from each other.

In some exemplary embodiments a magnet holds at least one chord forming capo clip that is made of material attracted to a magnet. That magnet is used as a storage device that is attached to a convenient location for a player to access, for example but not limited to sewn, or fabric taped to a guitar strap, or adhered to the headstock of the guitar allowing the player to easily store one or more chord forming capo clips when not in use.

In some exemplary embodiments the holes 220 in the ridged platform 215 can be in any shape and or size including but not limited to tapered, key hole, threaded, twist in like key, press in fitting, socket type, quick release pin, rail like fittings, lego type fittings, velcro, pressure fitted, rubber push-in bumpers. In some exemplary embodiments, the holes 220 in the ridged platform 215 are threaded and receive the inserts 240 that are also threaded and are the male and female counter parts to each other. The inserts 240 can be screwed in by hand similar to a bolt screwing into a nut. This allows for both attachment and a way to raise and lower the individual inserts 240 so they can be adjusted to the exact height or depth needed to hold down a particular string. Therefore, each insert 240 can be adjusted to a different height to match the thickness of the corresponding string they will come in contact with. In some exemplary embodiments only the holes 220 are threaded or having threads. In some exemplary embodiments only the inserts are threaded or having threads.

In some exemplary embodiments a slot 222 is used to hold an insert 240 allowing the insert 240 to be easily moved in what ever direction the slot 222 allows. Because the frets 40 of most stringed instruments get smaller as you go higher up the neck, the same chord forming capo clip 200 that works on the first few frets 40 might not work on the higher smaller frets 40, but by having a slot 222 that allows you to move the inserts 240 in various directions the user can use the same insert 240 formation on the lower wider frets 40 and by simply moving certain inserts 240 to the desired placement the same chord forming capo clip 200 could operate on the more thinly spaced frets 40 that are often higher up the neck, and or the same chord forming capo clip 200 that functions on the first fret 40 could function on the 12th fret 40 even though that fret 40 spacing is much smaller. This option makes chord forming capo clips 200 highly adaptable and instead of being functional on a limited few positions of a stringed instrument, allow it to virtually work anywhere up and down the neck of a stringed instrument. It is to be known that the slots 222 can be made to open in any direction including but not limited to horizontal, vertical, diagonal, circular, zigzag, and or any shape allowing the insert 240 to be moved in a unlimited variety of directions.

In some exemplary embodiments the holes 220 that except the rubber push-in bumpers used to fret a string can be made to accept any type of attachment that may be used to provide any kind of function or combination of functions including to mute/lightly dampen the string, or to lightly interact with the string or to create a harmonic, or to act as a leg that might straddle or be beside a string or strings 30 helping to add balance and stability, and or a retractable shape that can be adjusted to a variety of heights for any number of reasons including adapting to the differing height of a string.

In some exemplary embodiments, the chord forming capo clip 200 mixes both fretted notes and harmonic notes together. For example but not limited to a guitar tuned in E, A, D, G, B, E Spanish style tuning with a chord forming capo clip with inserts in the following configuration. A insert holding the A note by pressing down the low E string on the 5th fret, a insert holding a E harmonic by lightly pressing the A string above the 7th fret, a insert playing an A harmonic by lightly pressing the D string above the 7th fret, a insert playing a C# note by holding down the G string at the 6th fret. The sound of this chord when played mixes both fretted notes and harmonic notes. It is to be known that any configuration of inserts interacting with any shape chord forming capo clip can be used to create any combinations of notes and harmonic combination using this inventive concept.

In some exemplary embodiments a harmonic sound is created by inserting the smaller end of at least one insert 240 through a ridged platform 215 so the smaller end of the insert lightly touches the string above a fret to create a harmonic sound when played. By slightly touching the string at just the right height and location at various locations on a stringed instrument and including over the 12th fret 40 of a guitar a harmonic sound and or note can be created. This is a technique used on the opening notes of the song Roundabout by Yes.

In some exemplary embodiments, the inserts 240 are a quick release pin. In some exemplary embodiments, the inserts 240 are permanently fixed to the chord forming capo clip 200. In some exemplary embodiments, the inserts 240 are removable from the chord forming capo clip 200 and or any variation of permanent or removable insert 240 may be combined.

In some exemplary embodiments legs used to stabilize and or help balance the chord forming capo clips 200 are permanently attached and or attachable and detachable to the main rigid platform 215. These legs may be rest anywhere on the fingerboard 20, fret 40 and or stringed instrument.

In some exemplary embodiments the inserts 240 lock into the platform 215 with any method known or unknown including but not limited to key like male insert 240, lego snap type, threaded or screw in, latch, clip, pressure fitted.

In some exemplary embodiments the chord forming capo clip 200 can be held with the hand pressing it against the strings 30 allowing a player to move it into different fret 40 positions and therefore play different chords with out having to actually make the chord shape with their fingers.

In some exemplary embodiments the chord forming capo clip 200 has rings, ridges, holes 220 and or any method known or unknown that would allow a person to grip it with one hand and easily press it against the string. It is to be known that this would include any method of playing including but not limited to holding a chord forming capo 200 with left hand from under neck and strumming with right hand similar to traditional guitar playing, and or over the top of the neck, and or similar to a Dobro or slide guitar method of playing. In some exemplary embodiments the chord forming capos 200 have guides and or a ridge that lines up with any part of an instrument neck helping it stay in one horizontal plain while allowing it to be easily slide up and down the neck without getting out of register with the strings 30 that it is forming a chord on and or interacting with.

In some exemplary embodiments, the chord forming capo clips can have any kind of a radius and or bend. For example, the chord forming capo clip can be curved to fit shape of neck and or capo. In some exemplary embodiments the chord forming capo clips 200 have a fret 40 built on to the chord forming capo to allow it to fret a note and or notes on a fret less stringed instrument for example but not limited to a Cello, Violin, Electric Bass.

The chord forming capo clip 200 is not limited to these few written or drawn examples and it is an unlimited in scope. The devices and concepts laid out in this document is a system that can use any and all mentioned components and methods for any desired musical and or non musical effect. For example, the average guitar has 24 frets 40 and 6 strings 30 therefore creating thousands of variations with just a few of these ideas used together.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for depressing one or more strings along a neck of a stringed instrument, the method comprising:

positioning a planar frame above the one or more strings along the neck, such that each one of a plurality of compressible members extending through apertures of the frame is located above and in contact with a corresponding one of the strings; and engaging a compression device with an upper surface of the frame and rear surface of the neck, such that each string having one of the compressible members thereabove and in contact therewith is pressed between the compressible member and an upper surface of the neck; wherein said compression device is a capo having an upper portion, a lower portion and a biasing means for biasing the upper portion and lower portion toward each other.

2. A device for depressing one or more strings along a neck of a stringed instrument when engaged with a compression device, the device comprising:

a frame having a first planar surface defining a first side of the frame and a second planar surface defining a second side of the frame opposite from the first side;

a plurality of apertures in the frame; and a plurality of compressible members capable of being engaged with and disengaged from the aperture;

wherein the first planar surface of the frame comprises a central axis extending across an entire width of the frame, the central axis defining (i) a first region of the first planar surface at one side of the central axis having at least one aperture, and (ii) a second region of the first planar surface at an opposite side of the central axis having at least one aperture; and wherein when the compression device is engaged with the frame: (i) a first surface of the compression device is in contact with the central axis, and (ii) the compressible members contact and depress the one or more strings of the stringed instrument; wherein said compression device is a capo having an upper portion, a lower portion and a biasing means for biasing the upper portion and lower portion toward each other.

3. The method of claim 1, wherein the compressible members each have:

a first portion having a first circumference substantially identical in shape and size to a shape and size of the apertures, the first portion located within its corresponding aperture and above the frame; and a second portion with a second circumference substantially greater in size than the size of the apertures, the second portion located below the frame and in contact with the corresponding one of the strings.

4. The method of claim 1, wherein:

the compression device has an upper portion comprising a first surface, a lower portion comprising a second surface, and a biasing means biasing the first and second surfaces towards each other; and engaging the compression device comprises placing the first surface of the compression device in contact with the upper surface of the frame and placing the second surface in contact with the rear surface of the neck.

5. The method of claim 4, wherein engaging the compression device comprises engaging the compression device such that the upper portion of the compression device extends across a substantial portion of an entire width of the neck.

6. The method of claim 4, Wherein engaging the compression device comprises positioning the upper portion of the compression device substantially perpendicular to the length of the neck, such that:

a first portion of the frame is located at one side of the upper portion of the compression device, closer to a body of the stringed instrument than the upper portion of the compression device; and a second portion of the frame is located at an opposite side of the upper portion of the compression device, further away from the body of the stringed instrument than the upper portion of the compression device.

7. The method of claim 4, wherein engaging the compression device comprises positioning the upper portion of the compression device substantially directly above and in alignment with a fret of the stringed instrument.

8. The method of claim 1, wherein:

the upper surface of the frame comprises a central axis extending across an entire width of the frame, the central axis defining: (i) a first region of the frame at one side of the central axis having at least one aperture, and (ii) a second region of the frame at an opposite side of the central axis having at least one aperture; and engaging the compression device with the upper surface of the frame comprises engaging the compression device with the entirety of the central axis.

9. The method of claim 8, wherein:

the compression device has an upper portion comprising a first surface, a lower portion comprising a second surface, and a biasing means biasing the first and second surfaces towards each other; and engaging the compression device comprises: (i) placing the first surface of the compression device in, contact with the entirety of the central axis, and (ii) placing the second surface in contact with the rear surface of the neck.

10. The method of claim 8, wherein the central axis is without apertures.

11. The method of claim 10, wherein all of the apertures have an identical diameter, and the central axis has a width equal to or greater than the diameter of the apertures.

12. The device of claim 2, wherein the compressible members each have:

a portion with a first circumference substantially identical in shape and size to a shape and size of the apertures; and a portion with a second circumference substantially greater in size than the size of the apertures, and wherein when the compression device is engaged with the frame, the portions of the compressible members having the second circumference contact and depress the one or more strings of the stringed instrument.

13. The device of claim 12, wherein the frame has a uniform thickness, and when one of the compressible members is engaged with one of the apertures:

the portion of the compressible member having the first circumference is within the aperture and extends beyond the first planar surface of the frame a distance equal to or greater than the thickness of the frame; and the portion of the compressible member having the second circumference extends beyond the second planar surface of the frame a distance equal to or greater than the thickness of the frame.

14. The device of claim 2, wherein the central axis is without apertures.

15. The device of claim 14, wherein all of the apertures have an identical diameter, and the central, axis has a width equal to or greater than the diameter of the apertures.

16. The device of claim 2, wherein when the compression device is engaged with the frame, the first surface of the compression device is in contact with the entirety of the central axis.

17. The device of claim 2, wherein:

the compression device has an upper portion comprising the first surface, a lower portion comprising a second surface, and a biasing means biasing the first and second surfaces towards each other; and when the compression device is engaged with the frame, the first surface of the compression device is in contact with the entirety of the central axis, and the second surface of the compression device is in contact with a rear surface of the neck.

18. The device of claim 17, further comprising the compression device.

19. A device for depressing one or more strings along a neck of a stringed instrument when engaged with a compression device, the device comprising:

a frame having a first planar surface defining a first side of the frame and a second planar surface defining a second side of the frame opposite from the first side;

a plurality of apertures in the frame, at least one of the apertures having an oval shape; and a plurality of compressible members capable of being engaged with and disengaged from the apertures;

wherein the first planar surface of the frame comprises a central axis extending across an entire width of the frame, the central axis defining (i) a first region of the first planar surface at one side of the central axis having at least one aperture, and (ii) a second region of the first planar surface at an opposite side of the central axis having at least one aperture; and wherein when the compression device is engaged with the frame: (i) a first surface of the compression device is in contact with the central axis, and (ii) the compressible members contact and depress the one or more strings of the stringed instrument; wherein said compression device is a capo having an upper portion, a lower portion and a biasing means for biasing the upper portion and lower portion toward each other.

20. The device of claim 19, wherein when one of the compressible members is engaged with one of the at least one oval shaped apertures, the compressible member is able to be repositioned within the aperture by sliding the compressible member through the aperture in a direction parallel to the first planar surface, the compressible member remaining engaged with the aperture.

* * * * *